US007522108B2

(12) United States Patent
Heng et al.

(10) Patent No.: US 7,522,108 B2
(45) Date of Patent: Apr. 21, 2009

(54) ANTENNA GROUND STRUCTURE

(75) Inventors: Chew Chwee Heng, Singapore (SG); Yung Chang Wei, Sijihih (TW)

(73) Assignee: Amphenol Corporation, Wallingford, CT (US)

( * ) Notice: Subject to any disclaimer, the term of this patent is extended or adjusted under 35 U.S.C. 154(b) by 71 days.

(21) Appl. No.: 11/497,239

(22) Filed: Aug. 2, 2006

(65) Prior Publication Data

US 2007/0030204 A1 Feb. 8, 2007

Related U.S. Application Data

(60) Provisional application No. 60/705,177, filed on Aug. 4, 2005.

(51) Int. Cl.
*H01Q 1/24* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS

| | | | | |
|---|---|---|---|---|
| 6,045,668 | A * | 4/2000 | Fort et al. | 204/266 |
| 6,357,887 | B1 * | 3/2002 | Novak | 362/26 |
| 6,933,929 | B1 * | 8/2005 | Novak | 345/173 |
| 2005/0219140 | A1 * | 10/2005 | Browne et al. | 343/814 |

OTHER PUBLICATIONS

Laird Technologies; EMI Catalogs; "Metalized Conductive Products;" http://www.lairdtech.com/pages/catalogs/EMI-Catalogs-MetallizedConductiveProducts.asp.

* cited by examiner

*Primary Examiner*—HoangAnh T Le
(74) *Attorney, Agent, or Firm*—Blank Rome LLP

(57) ABSTRACT

An antenna ground structure, for use in an electronic apparatus includes an antenna main body and electrically conductive plastic material connecting the antenna main body is a metal frame of the electronic apparatus to provide an electrical connection between the antenna main body and the metal frame. Better electrical characteristics can be provided to the antenna main body through the antenna ground structure. The manufacturing process is further improved.

11 Claims, 2 Drawing Sheets

ANTENNA GROUND STRUCTURE

CROSS-REFERENCE TO RELATED APPLICATIONS

This application claims priority from and is related to U.S. Provisional Application No. 60/705,177, filed Aug. 4, 2005. This prior application, including the entire written description and drawing figures, is hereby incorporated into the present application by reference.

BACKGROUND OF THE INVENTION

1. Field of the Invention

The present invention relates to an antenna ground structure for use in an electronic device and, more particularly, to use of an electrically conductive foam for grounding of an antenna main body.

2. Background of the Related Art

Wireless communication technology is in widespread use for a portable electronic apparatus, like a notebook computer. An antenna is provided in the notebook computer to achieve transmission or receipt of data for the wireless communication technology. Hence, the antenna plays an important role during wireless communication. The function of the antenna is a window for transmitting and receiving energy of electromagnetic waves. The electrical characterization of the antenna may influence communication quality and can be an index for the intensity of signal for a wireless communication product. To improve the efficiency of electric wave communication, a better ground plane must be provided for a periphery of a feed point.

Referring to FIG. 1, a schematic diagram illustrates a conventional antenna ground structure. The antenna ground structure includes an antenna main body 11 and a ground metal plate 12. A ground plane of the antenna main body 11 is connected to the ground metal plate 12, as illustrated. The ground metal plate 12 connects to a metal frame of the electronic apparatus so as to provide better electrical characterization for the antenna main body 11.

However, the ground way needs bolts to connect the ground metal plate and the metal frame of the electronic apparatus and it cannot be readily modified based on required electrical characterization. Therefore, there is a need for a ground structure that can accommodate different types of connections, but that does not have the limitations discussed above with respect to the prior art systems.

SUMMARY OF THE INVENTION

Accordingly, one object of the present invention is to provide an antenna ground structure for use in an electronic apparatus. In one embodiment, the antenna main body is grounded by utilizing electrically conductive foam in particular.

In accordance with the antenna ground structure disclosed by the present invention for use in the electronic apparatus, the antenna ground structure includes the antenna main body and an electrically conductive plastic material. The antenna main body is connected to a metal frame of the electronic apparatus through the electrically conductive plastic material.

Therefore, the antenna ground structure could provide better electrical characterization for the antenna main body and improve manufacturing processes.

These and other objects of the invention, as well as many of the intended advantages thereof, will become more readily apparent when reference is made to the following description, taken in conjunction with the accompanying drawings.

BRIEF DESCRIPTION OF THE FIGURES

The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION OF THE PREFERRED EMBODIMENTS

Figure 1:
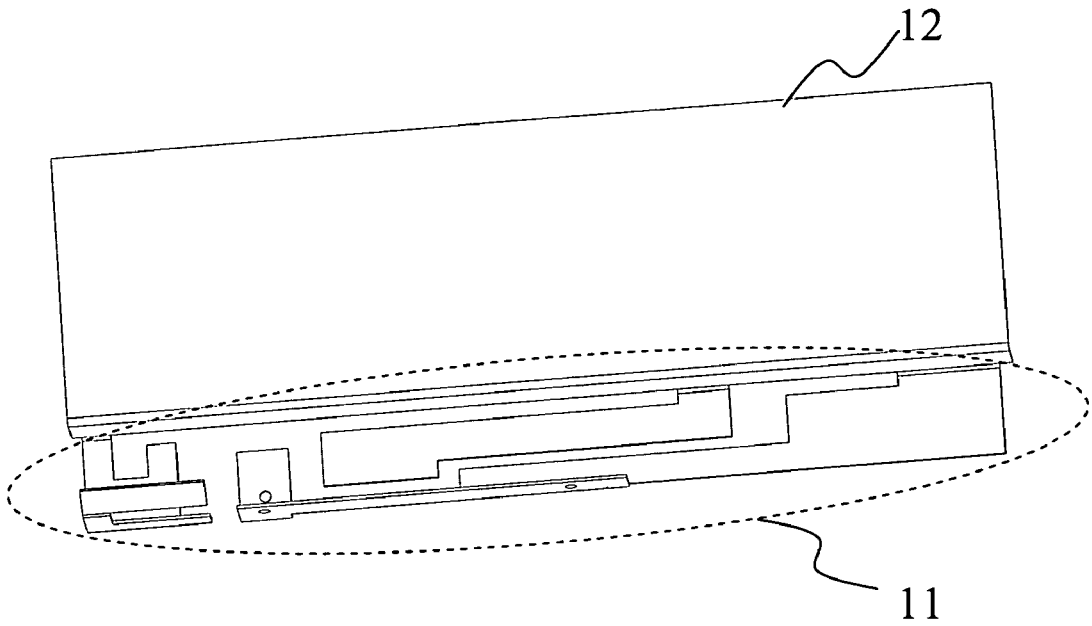
FIG. 1 is a schematic diagram illustrating a conventional antenna ground structure.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose.

Figure 2:
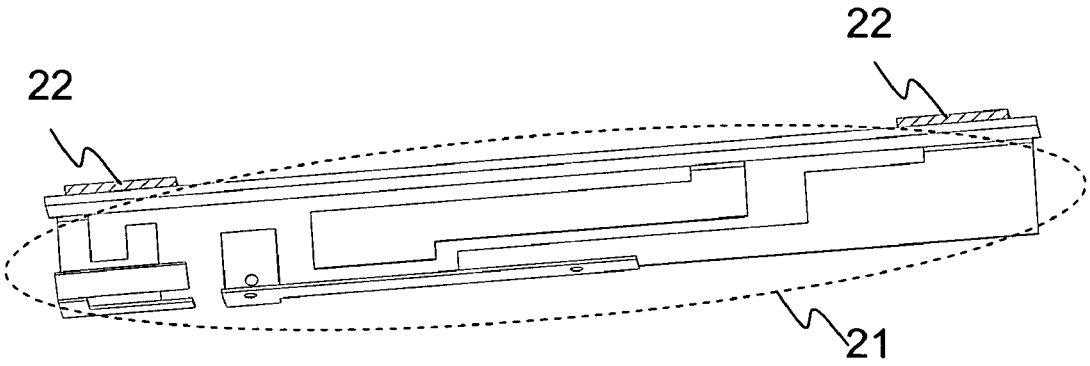
FIG. 2 is a schematic diagram illustrating an antenna ground structure computer according to an embodiment of the present invention.

Referring to FIG. 2, a schematic diagram illustrates an antenna ground structure according to one embodiment of the present invention. The antenna ground structure is applied to an electronic apparatus like, for example, a portable computer. The antenna ground structure has an antenna main body 21 and an electrically conductive plastic material 22.

The antenna main body 21 includes a radiation element which is operated at least one band and has a ground plane. The antenna main body 21 can be formed by a metal material and the band can be wireless communication bands such as Global System for Mobile Communication (GSM) 850, GSM 900, DCS 1800, Personal Communication System (PCS) 1900, Universal Mobile Telecommunication System (UMTS) and Wireless Local Area Network (WLAN).

The electrically conductive plastic material 22 connects the antenna main body 21 on the metal frame of the electronic apparatus. The electrically conductive plastic material 22 is, in at least one embodiment, electrically conductive foam which connects to a ground plane of the antenna main body 21. Because the electrically conductive foam has a stickiness, the antenna main body 21 can be fastened on the metal frame of the electronic apparatus. In some embodiments, foam is composed of nickel and copper. The foam may also be formed from layers, where the top and bottom surfaces are formed from a Ni/Cu knit polyester mesh and the core from a Ni/Cu metallized urethane core.

Figure 3:
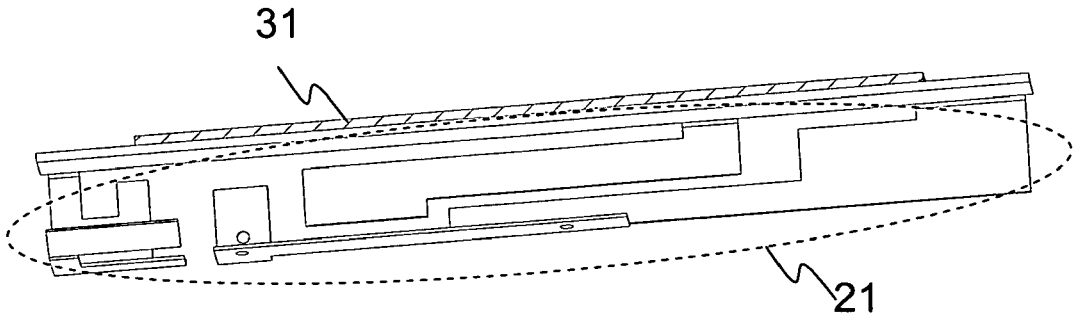
FIG. 3 is a schematic diagram illustrating an alternate antenna ground structure according to another embodiment of the present invention.
Figure 4:
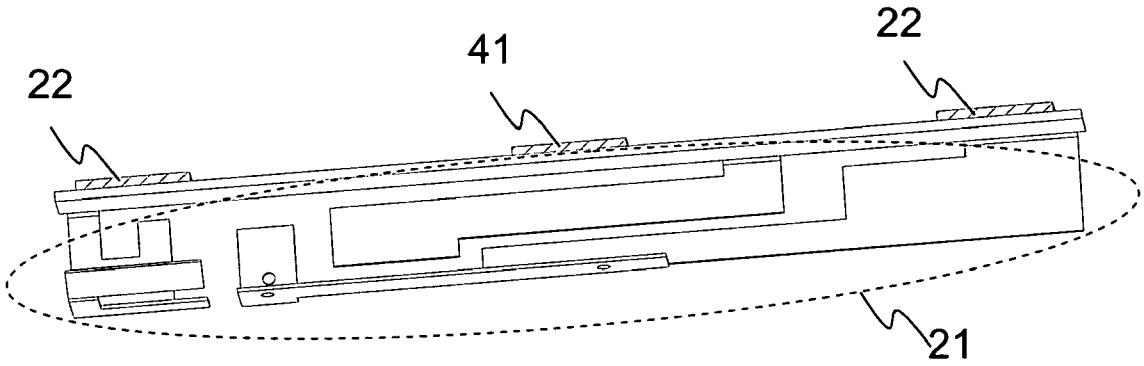
FIG. 4 is a schematic diagram illustrating an alternate antenna ground structure according to a further embodiment of the present invention.

Referring to FIGS. 3 and 4, FIG. 3 provides a schematic diagram illustrating an antenna ground structure according to another embodiment of the present invention. FIG. 4 is a schematic diagram illustrating an antenna ground structure according to a further embodiment of the present invention.

FIGS. 3 and 4 illustrate that the setting position of the electrically conductive plastic material can be dispersed in many ways based on the requirement of different electrical characterizations. Instead of the electrically conductive plastic material 22 set on two ends of the ground plane of the antenna main body 21, as shown in FIG. 2, an electrically conductive plastic material 31, as shown in FIG. 3, can be disposed at a central area of the ground plane of the antenna main body 21.

As shown in FIG. 4, electrically conductive plastic material 41 may be disposed on the central area of the ground plane of the antenna main body 21, but with the electrically conductive plastic material 22 set on the two ends of the ground plane of the antenna main body 21, as shown in FIG. 2. Therefore, the electrically conductive plastic material may be flexibly provided in many positions for the antenna ground structure and therefore modify electrical characteristics generated by grounding based on the radiation requirements.

Therefore, the electrically conductive plastic material provides better electrical characterization for the antenna main body and the antenna has better efficiency in the receipt and transmission of electromagnetic waves. The manufacturing process is further improved since the structure can more flexibly be manufactured.

Having thus described several aspects of at least one embodiment of this invention, it is to be appreciated various alterations, modifications, and improvements will readily occur to those skilled in the art. For example, while the use of the antenna ground structure has been discussed with respect to portable computers, the present invention is applicable to any electronic device that uses an antenna, including portable and stationary communication devices.

Such alterations, modifications, and improvements are intended to be part of this disclosure, and are intended to be within the spirit and scope of the invention. Accordingly, the foregoing description and drawings are by way of example only.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

We claim:

1. An antenna ground structure for use in an electronic apparatus, comprising:

an antenna main body; and electrically conductive plastic material connecting said antenna main body to a metal frame of the electronic apparatus to provide an electrical connection between the antenna main body and the metal frame.

2. The antenna ground structure of claim 1, wherein the electronic apparatus comprises a portable communication device.

3. The antenna ground structure of claim 2, wherein the portable communication device comprises a laptop computer.

4. The antenna ground structure of claim 1, wherein the antenna main body is formed from a metal material.

5. The antenna ground structure of claim 1, wherein the antenna main body further comprises a ground plane and the ground plane is electrically connected to the electrically conductive plastic material.

6. The antenna ground structure of claim 1, wherein the electrically conductive plastic material comprises electrically conductive foam.

7. The antenna ground structure of claim 1, wherein the antenna main body is configured to operate at least one band.

8. A method of connecting an antenna to a metal frame of an electronic apparatus through a ground structure, comprising the steps of:

presenting an antenna main body; and electrically connecting the antenna main body to the metal frame of the electronic apparatus through electrically conductive plastic material.

9. The method of claim 8, wherein the electronic apparatus comprises a portable communication device and the electrically connecting step comprises electrically connecting the antenna main body to the metal frame of the portable communication device through the electrically conductive plastic material.

10. The method of claim 8, wherein the electronic apparatus comprises a laptop computer and the electrically connecting step comprises electrically connecting the antenna main body to the metal frame of the laptop computer through the electrically conductive plastic material.

11. The method of claim 8, wherein the electrically conductive plastic material comprises electronically conductive foam and the electrically connecting step comprises spraying the electrically connected foam between the antenna main body and the metal frame.

* * * * *

UNITED STATES PATENT AND TRADEMARK OFFICE

CERTIFICATE OF CORRECTION

PATENT NO. : 7,522,108 B2
APPLICATION NO. : 11/497239
DATED : April 21, 2009
INVENTOR(S) : Chew C. Heng et al.

It is certified that error appears in the above-identified patent and that said Letters Patent is hereby corrected as shown below:

At Col. 2, line 40 "operated at least" should read -- operated at at least --

In Claim 7, at page 4, line 21 "operate at least" should read -- operate at at least --

Signed and Sealed this

Twenty-second Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,522,108 B2
APPLICATION NO. : 11/497239
DATED : April 21, 2009
INVENTOR(S) : Chew C. Heng et al.

It is certified that error appears in the above-identified patent and that said Letters Patent is hereby corrected as shown below:

At Col. 2, line 40 "operated at least" should read -- operated at at least --

In Claim 7, at Col. 4, line 21 "operate at least" should read -- operate at at least --

This certificate supersedes the Certificate of Correction issued December 22, 2009.

Signed and Sealed this

Twelfth Day of January, 2010

David J. Kappos

David J. Kappos
*Director of the United States Patent and Trademark Office*